US007686057B2

(12) United States Patent
Lampe

(10) Patent No.: US 7,686,057 B2
(45) Date of Patent: Mar. 30, 2010

(54) CLOSING SLEEVE FOR TUNNELS OF FOLDING CURTAINS

(75) Inventor: Dominique Lampe, Roeselare (BE)

(73) Assignee: BVBA Shadow Belgium (BE)

( * ) Notice: Subject to any disclaimer, the term of this patent is extended or adjusted under 35 U.S.C. 154(b) by 293 days.

(21) Appl. No.: 10/575,603

(22) PCT Filed: Oct. 12, 2004

(86) PCT No.: PCT/EP2004/011459

§ 371 (c)(1),
(2), (4) Date: Sep. 11, 2006

(87) PCT Pub. No.: WO2005/040543

PCT Pub. Date: May 6, 2005

(65) Prior Publication Data

US 2007/0006977 A1 Jan. 11, 2007

(30) Foreign Application Priority Data

Oct. 13, 2003 (BE) ..... 2003-0535

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***A47G 5/02*** | (2006.01) |
| ***A47H 1/00*** | (2006.01) |

(52) U.S. Cl. ..... 160/84.01; 160/264

(58) Field of Classification Search ..... 160/84.01, 160/84.04, 84.05, 124, 264, 288, 289, 290.1, 160/348, 349.1, 349.2; 248/200.1, 251, 252, 248/257, 259, 265, 269

See application file for complete search history.

(56) References Cited

U.S. PATENT DOCUMENTS

| | | | | |
|---|---|---|---|---|
| 742,989 | A * | 11/1903 | Hoyt | 160/288 |
| 2,689,349 | A * | 9/1954 | White | 2/132 |
| 3,481,641 | A * | 12/1969 | Berger et al. | 294/100 |
| 3,750,740 | A * | 8/1973 | Newman | 160/354 |
| 5,275,221 | A * | 1/1994 | Doehlemann | 160/84.04 |
| 5,988,254 | A | 11/1999 | Hanright | |
| 2005/0269040 | A1 * | 12/2005 | Nien | 160/84.01 |
| 2008/0017327 | A1 * | 1/2008 | Lamers et al. | 160/84.01 |

* cited by examiner

*Primary Examiner*—Katherine W Mitchell
*Assistant Examiner*—Jeremy C Ramsey
(74) *Attorney, Agent, or Firm*—Hyra IP, PLC; Clifford D. Hyra

(57) ABSTRACT

The invention relates to a method for closing off at least one tunnel (2) extending across the width of a folding curtain, after a strengthening rod (3) has been inserted into this tunnel on the one hand, and a folding curtain comprising at least one tunnel (2) extending across the width of the curtain, which has been provided with a strengthening rod (3) on the other hand. To that effect, a strengthening rod (3) is provided in the tunnel (2) at least one extremity of which is comprising a number of pointed projections (4) and that the tunnel (2) is closed off by pricking the said projections (4) through the wall of the tunnel.

21 Claims, 3 Drawing Sheets

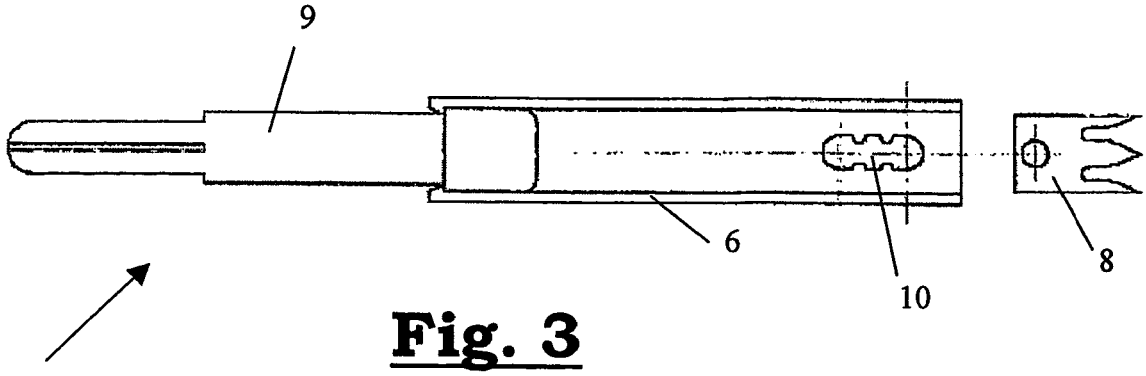
Fig. 3
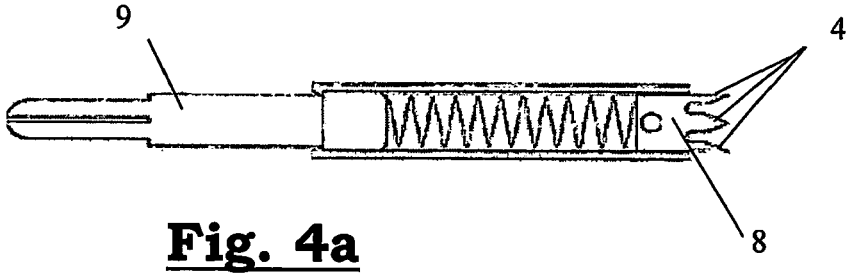
Fig. 4a
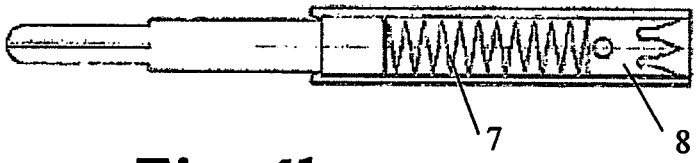
Fig. 4b
Fig. 4

CLOSING SLEEVE FOR TUNNELS OF FOLDING CURTAINS

This application claims the benefit of Belgian Application No. 2003/0535 filed Oct. 13, 2003 and PCT/EP2004/011459 filed Oct. 12, 2004, which are hereby incorporated by reference in their entirety.

BACKGROUND OF THE INVENTION

This invention relates to a method for closing off at least one tunnel extending across the width of a folding curtain, after a strengthening rod has been introduced into this tunnel on the one hand, and a folding curtain comprising at least one tunnel extending across the width of the curtain, which has been provided with a strengthening rod according to the invention on the other hand.

Folding curtains are often used as a decoration. A usual folding curtain is hanging straight down when it has been lowered completely. In order to obtain a curtain that is more tightened when it is lowered, the fabric is provided with tunnels that are stitched at different distances and extend across the full width of the curtain. Then, weightings, the so-called strengthening rods (or baleens) are introduced into the said tunnels mentioned above.

In order to be able to give the folding curtains a high quality, a few things are important:

- tunnels stitched in straight lines;
- the possibility to remove the strengthening rods from the curtains easily, so that they may be cleaned;
- strengthening rods ensuring a constant tension, so that the curtains will get a nice and straight aspect.

In order to make the tunnels perfectly straight, use is made of an automatic tunnel stitching device.

In order to be able to remove the strengthening rods from the curtains in a simple manner, it is known to provide an opening, more specifically a buttonhole on the lower side of the tunnel.

However, when a tunnel is provided with a buttonhole by means of the automatic tunnel stitching device, the following will occur: as the number of tunnels of each curtain will increase, the buttonhole will slide upwards when stitching the tunnels, because of which the buttonhole will be no longer in the lower part of the tunnel but on the upper part, so that it will become visible. This means a decrease in quality of the curtain, therefore no buttonholes may be provided when an automatic stitching device is used. It is only possible to make the perfect use of this machine if the tunnel is closed by stitching, but then it becomes impossible to remove the strengthening rods from the curtain for cleaning purposes.

SUMMARY OF THE INVENTION

The purpose of this invention is to provide a method which will make it possible to manufacture high quality folding curtains where it is possible to remove the strengthening rods from the curtains in a simple manner, so that it will be possible to clean them.

The purpose of the invention is attained by providing a method for closing at least one tunnel extending across the width of a folding curtain, after a strengthening rod has been provided in this tunnel, whereby a strengthening rod is provided in the tunnel that at least at one extremity comprises a number of pointed projections, and that the tunnel is closed by pricking the said projections through the wall of the tunnel.

By closing a tunnel of a folding curtain in accordance with this method, it will be possible to remove the strengthening rods from the tunnel very easily.

Preferably, the said projections are provided on an element made of synthetic material, for instance. The said element may be manufactured by means of injection moulding, for instance.

In a preferred method according to the invention, the said projections are movable against a spring force. The advantage of this method is that the strengthening rods will ensure a constant tension for one thing, because of which the curtains will have a nice and straight aspect. For another thing, it will be possible to press the pointed projections, for instance, by means of a narrow object, thus releasing them from the wall of the tunnel and allowing the strengthening rods to be removed from the tunnel.

In a more preferred method according to the invention, the said projections are part of a terminal element provided on the strengthening rod. More particularly, the said terminal element is carried out in the form of a sleeve provided at the extremity of the strengthening rod.

In a most preferred method according to the invention, the terminal element is provided with a coiled spring in order to exert a spring force on the said projections.

Another object of the present invention is a folding curtain comprising at least one tunnel extending across the width of the curtain, which is provided with a strengthening rod, the said strengthening rod comprising a number of pointed projections at least at one extremity and the said projections pricking through the wall of the tunnel in order to close off the tunnel.

Such folding curtains have the advantage that the strengthening rods may be removed from the tunnel in a simple manner.

In a preferred embodiment of the folding curtain according to the invention, the said projections are movable against the force of a spring. This makes it possible to press the projections, for instance, by means of a narrow object and, thereby remove the strengthening rods from the tunnel in a simple manner.

In a more preferred embodiment of the folding curtain according to the invention, the said projections are part of a terminal element provided at the extremity of the strengthening rod.

In a most preferred embodiment of the folding curtain according to the invention, the said terminal element comprises a sleeve-shaped jacket containing a coiled spring and an element provided with the said pointed projections, and the element being movable against the force of the coiled spring. Preferably, the said element is made of synthetic material.

By manufacturing folding curtains provided with said terminal element, various advantages are obtained:

- the strengthening rods will ensure a constant tension;
- the tunnel may be closed without being obliged to close it by stitching;
- the automatic tunnel stitching device can be used;
- no buttonhole has to be provided which means an important gain of production time.

Furthermore, this invention relates to a strengthening rod for a folding curtain, the said strengthening rod comprising a number of pointed projections at least at one extremity, and the said projections being provided to prick through the wall of the tunnel in order to close off the tunnel. The said strengthening rods of this patent application may be carried out both in a solid and in a hollow embodiment.

In a preferred embodiment of the strengthening rods according to the invention, the said projections are part of a terminal element provided on the strengthening rod. Furthermore, the said strengthening rod comprises a sleeve-shaped jacket containing a coiled spring and an element provided with the said pointed projections, the element being movable, against the force of the coiled spring, from a first to a second position, the element in its second position being situated within the space surrounded by the sleeve-shaped jacket.

In a most preferred embodiment, the strengthening rod according to the invention is provided in a folding curtain according to any one of the claims 6 up to and including 10.

In order to further clarify the properties of the present invention, and to point out its additional advantages and particulars, a more detailed description of the method applied and of a folding curtain manufactured in accordance with this method will now follow. It may be obvious that nothing in the following description may be interpreted as being a restriction of the protection of the present invention demanded for in the claims.

BRIEF DESCRIPTION OF THE DRAWINGS

In this description, by means of reference numbers, reference is made to the attached drawing in which:

FIG. 3 is representing another embodiment of a terminal element;

FIG. 4 is a representation of the first (FIG. 4*a*) and second positions (FIG. 4*b*) of element 8.

DETAILED DESCRIPTION OF THE PREFERRED EMBODIMENTS

Figure 1:
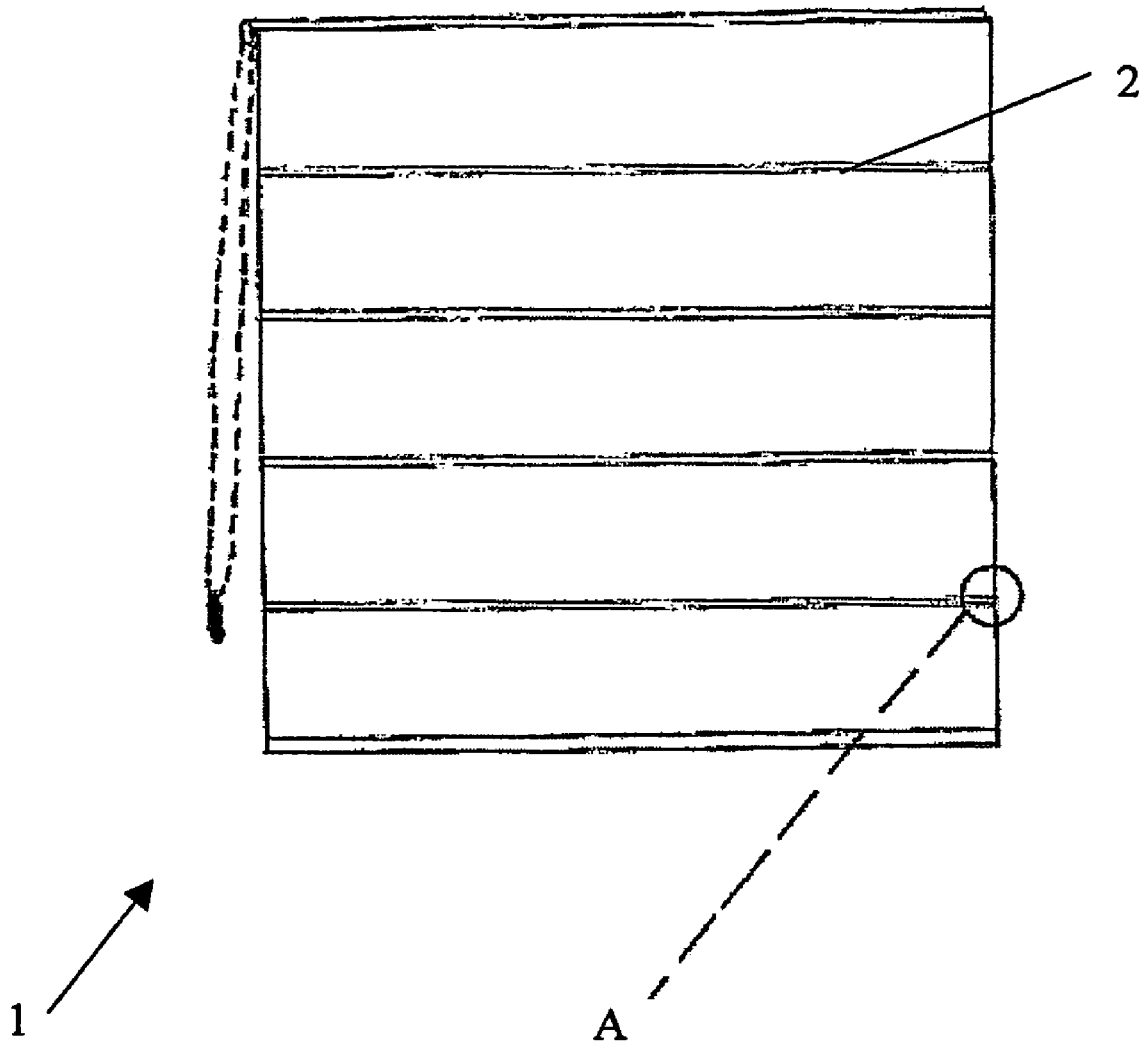
FIG. 1 is a representation of a folding curtain according to the invention.

A folding curtain (1) as represented in FIG. 1 has systems which are moving up and down the fabric of the curtain (1), for instance, by means of cords. They can be operated, as represented in FIG. 1, by a cord or chain system.

By stitching, horizontal tunnels (2) are made in the fabric of the curtain at regular intervals by means of an automatic stitching device. At one extremity, the tunnels (2) are closed by stitching. Then, elongated strengthening rods (3), which may be made solid or hollow, are inserted into these tunnels (2). They cause the fabric to fold when the curtain (1) is raised and the folds will cover one another. When lowered a segmented division will show.

The strengthening rods (3), made of fiberglass, for instance, are made somewhat shorter than the width of the folding curtain (1) and they are provided with a terminal element (5), at the extremity of the tunnel not closed by stitching.

Figure 2:
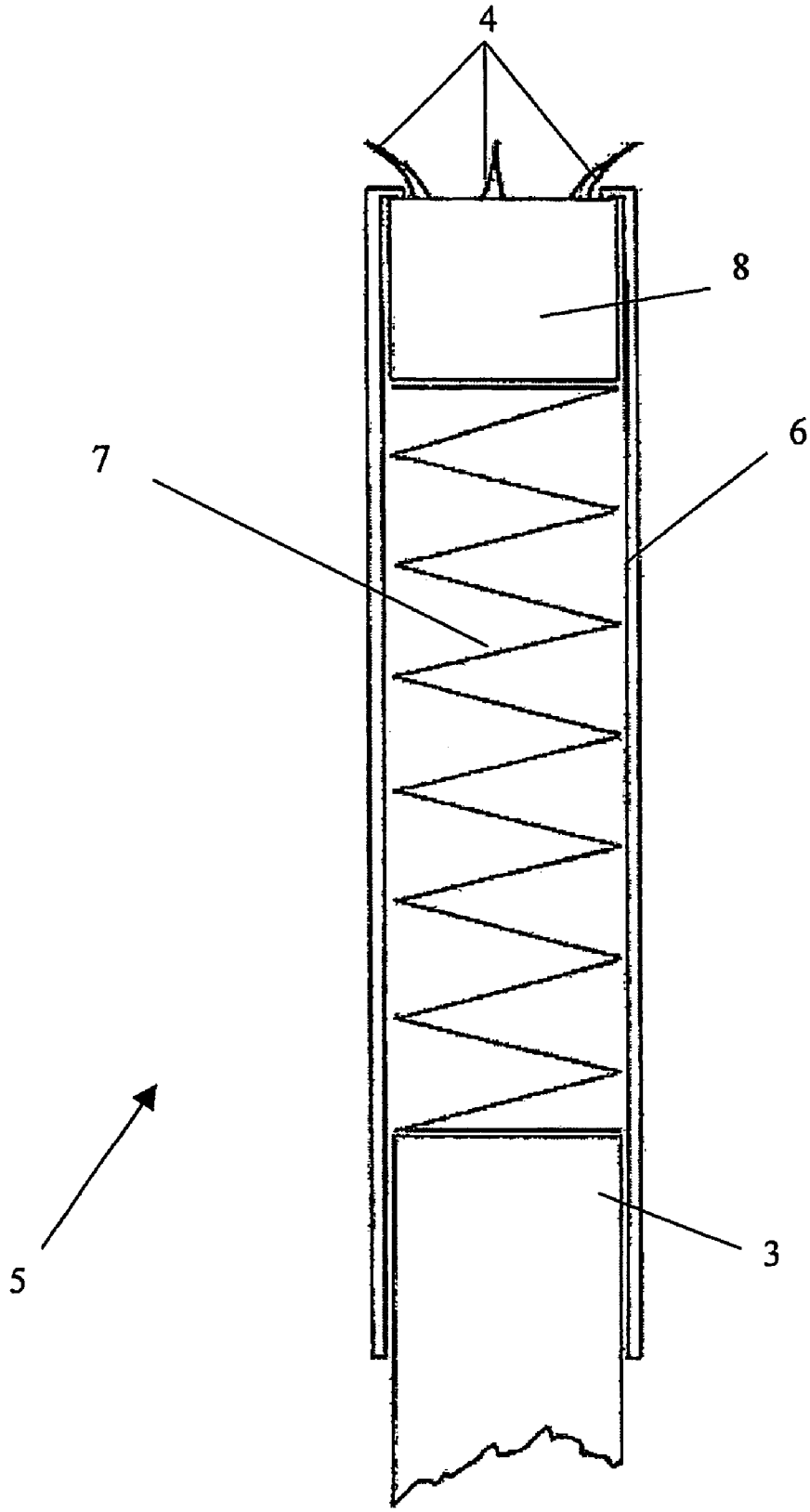
FIG. 2 is a detailed drawing of (A), more particularly of the terminal element.

As represented in FIG. 2, the terminal element (5) is carried out in the form of a sleeve (6), provided on the extremity of a strengthening rod (3).

The terminal element (5) comprises:

a sleeve-shaped jacket (6);

an element (8) equipped with pointed projections (4);

a coiled spring (7) which will render the element (8) movable against the force of the spring;

and, if needed, an additional connecting piece (9).

The sleeve (6), as carried out in FIG. 2, has two openings situated opposite one another, one opening sliding over the strengthening rod (3) and the other opening being provided with retaining edges. The retaining edges prevent the element (8) from being pushed out of the sleeve (6). In order to be able to move the element (8) against the spring force, the sleeve (6) has likewise been provided with a coiled spring (7).

In another embodiment, represented in FIGS. 3 and 4, where the strengthening rod (3) has been made hollow, the terminal element (5) is provided on the hollow strengthening rod (3), by means of a connecting piece (9) mounted on the sleeve (6).

Therefore, in order to close off a tunnel (2) of a curtain (1) according to the method in accordance with the invention, on the side of the tunnel (2) not closed off by stitching, either a terminal element (5) is slid over the strengthening rod (3), or a terminal element (5) is slid into the hollow strengthening rod by means of a connecting piece (9). Then, the extremity not closed by stitching should be kept somewhat closed, allowing the pointed projections (4) of the element (8) to prick through the wall of the tunnel, thus closing off the tunnel. The element (8) is now situated in its first position (FIG. 4*a*).

In order to reopen the tunnel (2), and thus being able to remove the strengthening rods (3) again, pressing the element (8) by means of a narrow object, for instance, a tooth pick, will suffice. This will bring the element (8) into its second position (see FIG. 4*b*) and the projections (4) will free themselves from the wall of the tunnel. Because of the force of the spring (7), the terminal element (5) will leave the tunnel (2) and the strengthening rod may be removed again.

Furthermore, the terminal element (5) may be provided with a recess (10), for instance, in the shape of a flat eight, in order to keep the element (8) in its first or second position. The transition from the second, in which the element (8) is situated within the space surrounded by the sleeve-shaped jacket, to the first position occurs by moving the sleeve (6) slightly backwards.

An additional advantage of the terminal element (5) lies in the fact that the spring (7) will maintain a constant tension on the folding curtain.

The invention claimed is:

1. Method for closing off at least one tunnel extending across the width of a folding cuff am, after a strengthening rod has been inserted into this tunnel, characterized in that the strengthening rod is provided in the tunnel, comprising a force generating member that extends or contracts in a longitudinal direction and a number of pointed projections positioned such that extension of the force generating member causes the pointed projections to extend in a radial direction as well as the longitudinal direction, and in that the tunnel is closed by extending the force generating member and pricking the pointed projections through a wall of the tunnel and the tunnel is allowed to open by retraction of the pointed projections away from the wall of the curtain tunnel.

2. Method according to claim 1, characterized in that the pointed projections are part of a terminal element, provided on the strengthening rod.

3. Method according to claim 2, characterized in that the terminal element is carried out in the form of a jacket provided on the extremity of the strengthening rod.

4. Method according to claim 2, characterized in that the terminal element comprises the force generating member.

5. Folding curtain comprising at least one tunnel extending across the width of the curtain, which is provided with a strengthening rod, characterized in that the strengthening rod comprises a force generating member that extends or contracts in a longitudinal direction and a number of pointed projections positioned such that extension of the force generating member causes the pointed projections to extend in a radial direction as well as the longitudinal direction and in that the projections are pricking through the wall of the tunnel in order to close the tunnel and the tunnel is allowed to open by retraction of the pointed projections away from the wall of the curtain tunnel.

6. Folding curtain according to claim 5, characterized in that the pointed projections are part of a terminal element provided on the strengthening rod.

7. Folding curtain according to claim 6, characterized in that the terminal element comprises a jacket containing the force generating member and an element provided with the said pointed projections and in that the element is movable against the spring force of the force generating member.

8. Folding curtain according to claim 5, characterized in that the pointed projections are made of synthetic material.

9. Strengthening rod for a folding curtain, characterized in that said strengthening rod comprises a force generating member that extends or contracts in a longitudinal direction and a number of pointed projections positioned such that extension of the force generating member causes the pointed projections to extend in a radial direction as well as the longitudinal direction and in that the projections are provided to prick through and grip a wall of a curtain tunnel, in order to close the tunnel and to retract away from the wall of the curtain runnel, in order to release the grip and allow the tunnel to open.

10. Strengthening rod according to claim 9, characterized in that the projections are part of a terminal element provided on the strengthening rod.

11. Strengthening rod according to claim 9, characterized in that the said strengthening rod comprises a jacket containing the force generating member and an element provided with the said pointed projections and in that the element is movable against the spring force of the force generating member from a first to a second position, the element in its second position being situated within the space surrounded by the jacket.

12. Strengthening rod according to claim 9, characterized in that the strengthening rod is provided in a folding curtain according to any one of the claims 6 up to and including 10.

13. Method according to claim 4, wherein the force generating member is a coiled spring.

14. Folding curtain comprising at least one tunnel extending across the width of the curtain, which is provided with a strengthening rod, characterized in that the strengthening rod comprises a force generating member that extends or contracts in a longitudinal direction and a number of pointed projections positioned such that extension of the force generating member causes the pointed projections to extend in the longitudinal direction and in that the projections are pricking through a wall of the tunnel in order to close the tunnel, and to retract away from the wall of the curtain tunnel in order to allow the tunnel to open, wherein the projections are part of a terminal element provided on the strengthening rod, the terminal element comprises a jacket provided on the extremity of the strengthening rod, and the pointed projections move into and out of a position completely contained within the space surrounded by the jacket.

15. Folding curtain according to claim 14, wherein the force generating member is a coiled spring.

16. Folding curtain according to claim 14, characterized in that the pointed projections are made of synthetic material.

17. Folding curtain according to claim 14, characterized in that the jacket contains the force generating member and an element provided with the said pointed projections and in that the element is movable against the spring force of the force generating member.

18. Strengthening rod for a folding curtain, characterized in that said strengthening rod comprises a force generating member that extends or contracts in a longitudinal direction and a number of pointed projections positioned such that extension of the force generating member causes the pointed projections to extend in the longitudinal direction and in that the projections are provided to prick through and grip a wall of a curtain tunnel, in order to close the tunnel, and to retract away from the wall of the curtain tunnel, in order to release the grip and allow the tunnel to open, wherein the projections are part of a terminal element provided on the strengthening rod, the terminal element comprises a jacket provided on the extremity of the strengthening rod, and the pointed projections move into and out of a position completely contained within the space surrounded by the jacket.

19. Strengthening rod according to claim 18, wherein the force generating member is a coiled spring.

20. Strengthening rod according to claim 18, characterized in that the jacket contains the force generating member and an element provided with the said pointed projections and in that the element is movable against the spring force of the force generating member from a first to a second position, the element in its second position being situated within the space surrounded by the jacket.

21. Strengthening rod according to claim 18, characterized in that the said strengthening rod is provided in a folding curtain according to any one of the claims 6 up to and including 10.

* * * * *